US008740260B1

(12) United States Patent
Liew

(10) Patent No.: US 8,740,260 B1
(45) Date of Patent: Jun. 3, 2014

(54) RAPID MAKE UP DRIVE SCREW ADAPTER

(71) Applicant: Vetco Gray Inc., Houston, TX (US)

(72) Inventor: Joseph Shu Yian Liew, Singapore (SG)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/693,342

(22) Filed: Dec. 4, 2012

(51) Int. Cl.
*F16L 23/00* (2006.01)

(52) U.S. Cl.
USPC ..... 285/364; 285/406

(58) Field of Classification Search
USPC ..... 285/366, 365, 364, 407, 411, 410, 406
See application file for complete search history.

(56) References Cited

U.S. PATENT DOCUMENTS

| | | | | | |
|---|---|---|---|---|---|
| 2,836,117 | A * | 5/1958 | Lankford | 285/365 |
| 2,868,565 | A * | 1/1959 | Suderow | 285/406 |
| 4,146,261 | A * | 3/1979 | Edmaier et al. | 285/364 |
| 4,327,942 | A * | 5/1982 | Abbes et al. | 285/365 |
| 4,460,201 | A * | 7/1984 | McGugan | 285/365 |
| 4,606,557 | A * | 8/1986 | Coffey | 285/404 |
| 5,149,143 | A * | 9/1992 | Howell | 285/366 |
| 5,158,326 | A * | 10/1992 | Anderson et al. | 285/917 |
| 5,443,581 | A * | 8/1995 | Malone | 285/364 |
| 5,456,321 | A * | 10/1995 | Shiach et al. | 166/382 |
| 5,951,066 | A * | 9/1999 | Lane et al. | 285/364 |
| 6,530,716 | B2 * | 3/2003 | Grimmel | 285/366 |
| 8,316,948 | B2 * | 11/2012 | Stringfellow et al. | 285/123.1 |
| 8,430,433 | B2 * | 4/2013 | Maier et al. | 285/411 |
| 2009/0032265 | A1 | 2/2009 | Borak, Jr. et al. | |

OTHER PUBLICATIONS

ABB Vetco Gray, "The NT-2 Connection System", Mar. 1999, 8 pgs.

* cited by examiner

*Primary Examiner* — David E Bochna
(74) *Attorney, Agent, or Firm* — Bracewell & Giuliani LLP

(57) ABSTRACT

An assembly for clamping a flanged tubular components, the assembly including a segmented clamp having a recess configured to accept the flanges of the tubular components, and a hole oriented substantially perpendicular to the longitudinal axes of the tubular components. The assembly also includes a housing surrounding an outer portion of the segmented clamp and configured for attachment to at least one of the tubular components, and a drive screw that passes through the housing and is threadedly engaged with the hole of the segmented clamp. As the drive screw rotates, it drives the segmented clamp perpendicularly relative to the tubular components between a locked position, in which the circumferential recess engages the flanges of the tubular components, and an unlocked position, in which the circumferential recess is positioned laterally out of engagement with the flanges of the tubular components.

18 Claims, 4 Drawing Sheets

RAPID MAKE UP DRIVE SCREW ADAPTER

BACKGROUND OF THE INVENTION

1. Field of the Invention

This technology relates to oil and gas wells, and in particular to adaptors for clamping connectors in oilfield equipment.

2. Brief Description of Related Art

Conventional adapters for joining tubular wellhead components, such as API hub connectors, have two-piece clamps that are positioned to engage the flanges of the components, and are joined with bolts. The wellhead components may be, for example, a casing or wellhead, and a tubing head. Such adapters are often slow and cumbersome to stall. In addition, such adapters may be unreliable, thereby allowing leakage between the flanges, and raising environmental and safety concerns. Alternative adapters have been developed to overcome the shortcomings of conventional two-piece clamps. For example, some adapters may drive dogs around the flanges to clamp the flanges together. However, many of these adapters require vendor-specific non-standard threads or other features on the components or equipment to which they are applied. This prohibits the use of such adapters with any equipment that is not specifically designed for use with that adapter. This also prevents use of the adapter to retrofit equipment originally supplied by a vendor other than the vendor of the adapter. What is needed, therefore, is an adapter that is more reliable than the conventional two-piece clamp adapter, but that can be used universally with any oil field equipment manufactured by any vendor.

SUMMARY OF THE INVENTION

Disclosed herein is an adapter for clamping flanged, or hub, ends of first and second tubular components. The adapter includes a clamp that may have two split halves, or a plurality of dog segments, with each half or dog segment having a hole extending therethrough. Each half or dog segment also includes upper and lower protrusions that define a recess therebetween, and that are spaced to accept the flanges at the ends of the first and second tubular components.

The adapter also includes a housing that surrounds at least an outer portion of the clamp. The housing is configured for removable attachment to either the first or second tubular component, or both. Such attachment may be accomplished by means of fasteners attaching the housing to the tubular component(s), or threads on the surface of the housing configured to engage threads on the surface of the tubular component(s).

A plurality of drive screws pass through the housing and engage threads in the holes of the clamp. As each drive screw rotates, it drives a half or dog segment of the clamp perpendicularly relative to the first and second tubular components. When the screw drives the clamp into engagement with the flanges, the clamp is in a locked position. Alternatively, when the screw drives the clamp away from, and out of engagement with, the flanges, the clamp is in an unlocked position.

This adapter is stronger and more robust than conventional split-type, two-piece clamps that consist only of the clamp to hold the faces of the connectors together. The adapter disclosed herein includes both an inner clamping device, and an outer housing that adds strength to the adapter assembly. This increases the ability of the adapter to withstand increased pressure and bending forces compared to conventional clamp designs.

BRIEF DESCRIPTION OF THE DRAWINGS

The present technology will be better understood on reading the following detailed description of nonlimiting embodiments thereof and on examining the accompanying drawings, in which.

DETAILED DESCRIPTION OF THE PREFERRED EMBODIMENT

Figure 1A:
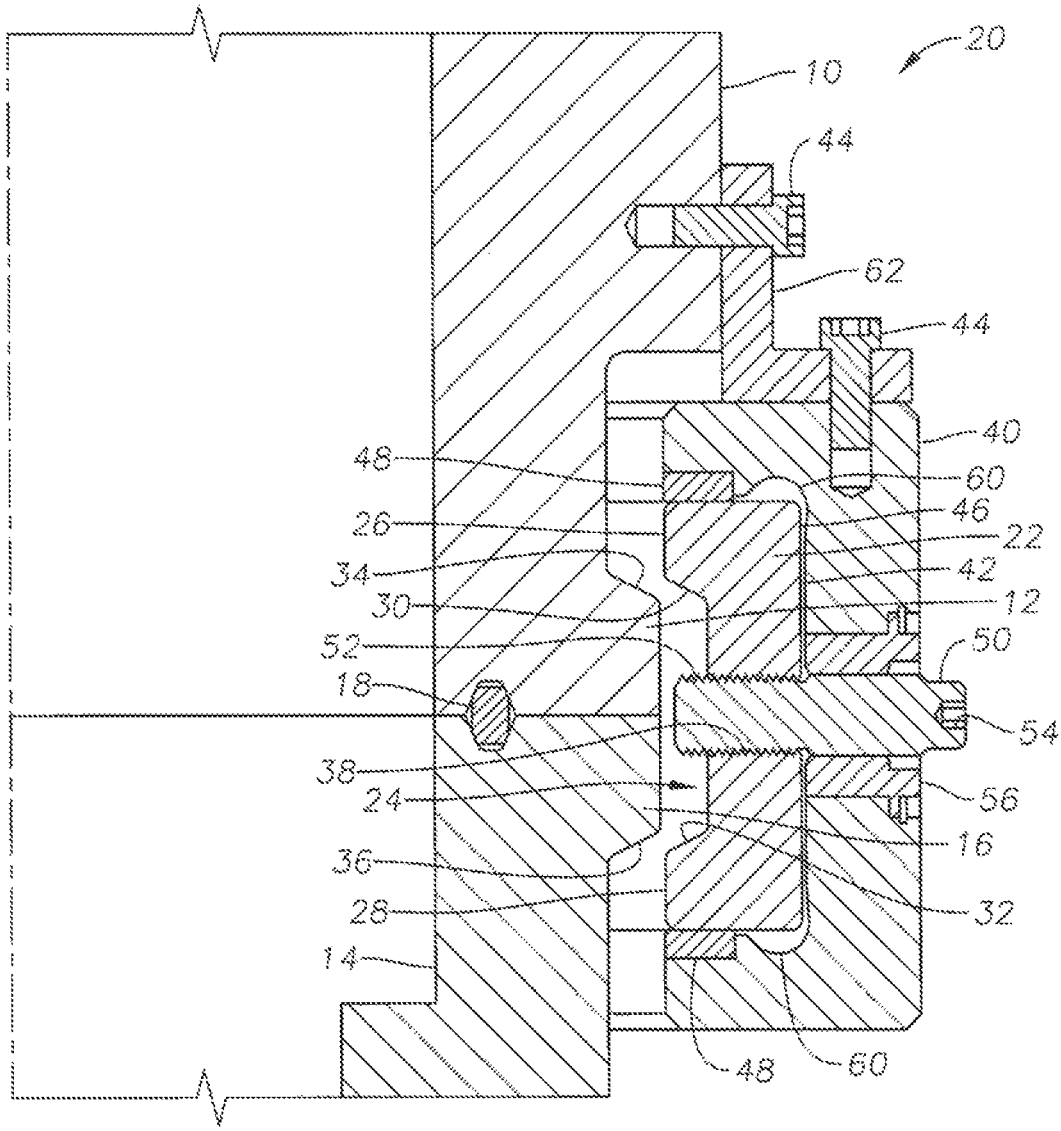
FIG. 1A is a side cross-sectional view of a connection assembly according to an embodiment of the present technology, with the clamp in an unlocked position.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

Many oilfield operations require the connection of adjacent tubular components, such as API hub connectors. Such tubular components may typically include wellhead components, like casing heads or tubing heads. For example, as shown in FIG. 1A, such equipment may include a first tubular component 10 having a first flange 12 at a lower end. The first tubular component 10 may be attached to a corresponding second tubular component 14, which has a second flange 16. Typically, when the first and second tubular components 10, 14 are joined, a seal 18 is positioned therebetween to prevent fluids from leaking through the joint at the interface between the flanges 12, 16. As shown, for example, in FIG. 1A, an adapter assembly 20 according to the present technology may be used to lock the first and second flanges 12, 16 together. Such an adapter assembly 20 connects the first and second tubular components 10, 14, and keeps them from separating. The adapter assembly described herein is compact, and fits within the minimum clearance outlined by the API 16A standard, as promulgated by the American Petroleum Institute. Accordingly, the adapter assembly 20 may be used with any API 6A hub connection, including those supplied by any vendor.

Figure 1B:
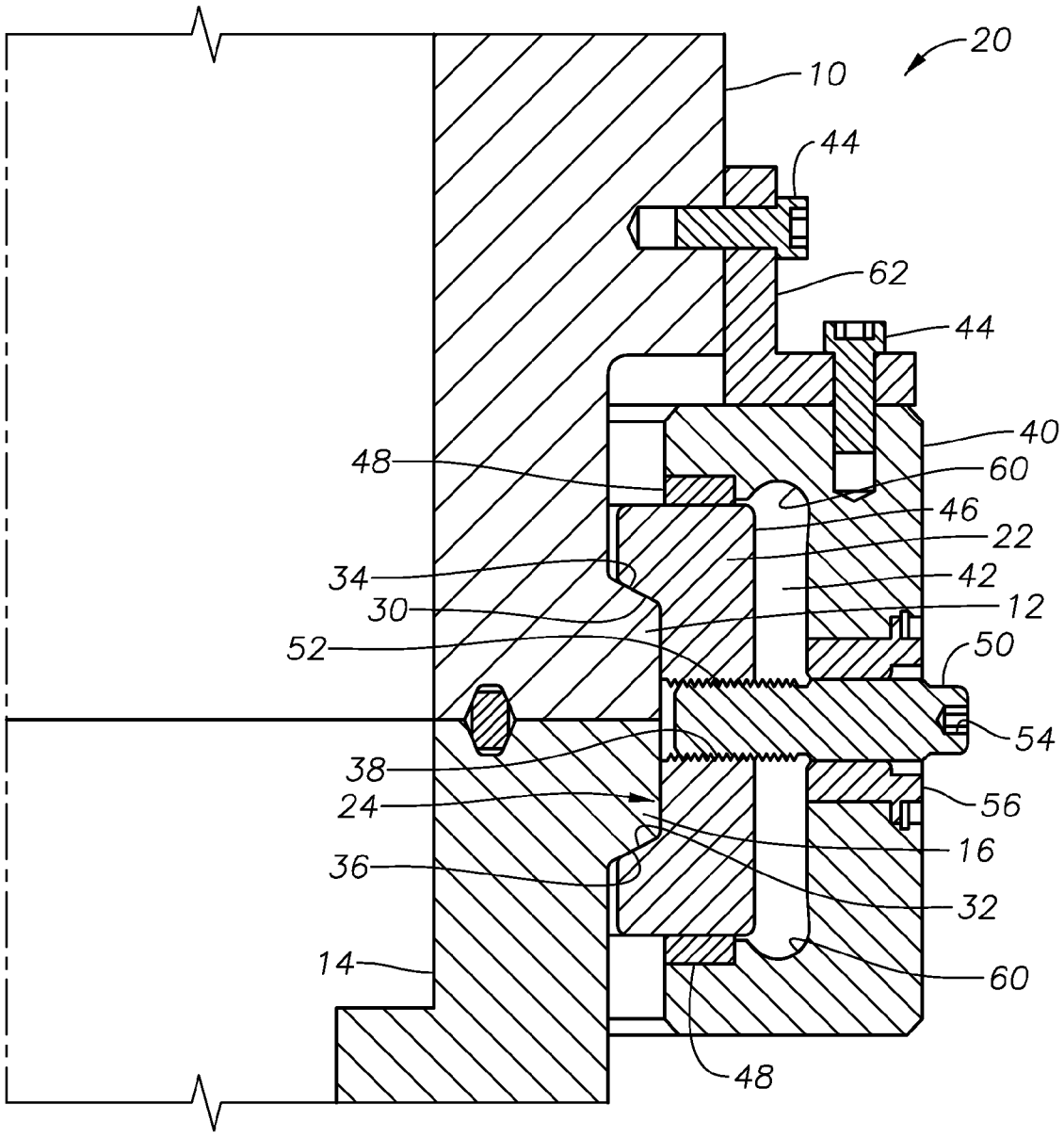
FIG. 1B is a side cross-sectional view of the connection assembly according to the embodiment of FIG. 1A, with the clamp in a locked position.

The adapter assembly includes a clamp 22 having a recess 24. The clamp 22 may be divided into separate halves, or multiple dog segments, around the circumference of the first and second tubular components 10, 14. The clamp 22 is configured to move between an unlocked position, shown in FIG. 1A, and a locked position, shown in FIG. 1B, and as described in detail below. When the clamp 22 is in the locked position, as shown in FIG. 1B, the recess 24 accepts the first and second flanges 12, 16. The recess 24 is bounded on the top and the bottom by an upper protrusion 26 and a lower protrusion 28 respectively, and is configured to accept the first and second flanges 12, 16 when the flanges 12, 16 are joined together. In addition, each section, or dog segment, of the clamp 22 includes a hole 38 that may be threaded.

The upper and lower protrusions 26, 28 of the clamp 22 may optionally have tapered surfaces 30, 32 configured to substantially correspond to matching tapered surfaces 34, 36 of the first and second flanges 12, 16. This allows a more even distribution of forces on the clamp 22 by the flanges 12, 16 when the clamp is in the locked position. In addition, the tapered surfaces may allow easier entry of the flanges 12, 16 into the recess 24 as the clamp 22 moves into a locked position, even when the flanges 12, 16 are not perfectly aligned with the clamp 22. Furthermore, as the tapered surfaces 30, 32 of the upper and lower protrusions 26, 28 engage the tapered surfaces 34, 36 of the first and second flanges 12, 16, the protrusions 26, 28 will tend to squeeze the flanges 12, 16 together, thereby strengthening the seal between the flanges.

In FIGS. 1A and 1B, a housing 40 is shown attached to the first tubular component 10, and substantially surrounding at least the outside, upper, and lower portions of the clamp 22. Although not shown, the housing 40 may alternatively be attached to the second tubular component 14, or to both the first and second tubular components 10, 14 simultaneously. The housing 40 may be a single annular piece that surrounds the clamp 22. Internal corners 60 of the housing 40 may be radiused, as shown, thereby decreasing stress concentrations in the housing 40. The housing 40 provides additional structural support to the adapter assembly 20 compared with a conventional clamp assembly that does not include such a housing 40.

In the embodiment shown in FIGS. 1A and 1B, the housing 40 is attached to the first tubular component 10 by fasteners 44 and a bracket 62. The bracket 62 is an L-shaped member having an upright portion bolted to the first tubular member 10 by a bolt. Fastener 44 extends axially downward through a hole in the horizontal part of the bracket 62 into a threaded hole in the housing 40. The bracket 62 may be an annular member that surrounds the first tubular component 10. Alternatively, there may be multiple brackets 62 attached to the housing 40 and the first tubular component 10 at discrete intervals around the first tubular component 10. The inner diameter of the housing 40 may be less than the inner diameter of the bracket 62. Such an arrangement allows the housing 40 to be easily retrofit onto any existing tubular component, regardless of vendor, by hole forming a threaded hole in the tubular component to accept the fastener 44. Accordingly, the adapter assembly 20 may be used with existing equipment at an oil drilling site.

The housing 40 provides a channel 42 in which the clamp 22 runs. The channel is defined by downward and upward facing flat surfaces that are perpendicular to the longitudinal axis of the first and second tubular components. When in its unlocked position, as shown in FIG. 1A, the clamp 22 is retracted into the channel 42, with an outside surface 46 of the clamp 22 proximate to the housing 40. Conversely, when in its locked position, as shown in FIG. 1B, the clamp 22 is extended at least partially out of the channel 42. Optional wear pads 48 may be positioned on the upper and lower fiat surfaces of the channel 42 between the housing 40 and the clamp 22 to protect the surfaces of the housing 40 and the clamp 22 as the clamp 22 moves relative to the housing 40. The wear pads 48 protect surfaces from wear by being constructed of a high strength material that is less susceptible to deterioration over time. The wear pads 48 act to reduce the friction between moving parts, and prolong the life and usage of the parts. in addition, the wear pads 48 are replaceable, adding further flexibility to the design. The channel 42 may be dimensioned so that the clamp 22 fits therein with limited tolerance, thereby helping to ensure that the clamp sections or dog segments remain square to the ends of the first and second flanges 12, 16.

Movement of the clamp 22 between its unlocked and locked positions is effected by drive screws 50. There may be a drive screw 50 corresponding to each clamp section or dog segment. Each drive screw 50 is configured to pass through a hole in the outer sidewall of the housing 40 and into a hole 38 in the clamp 22. Threads 52 on each drive screw 50 interact with corresponding threads on each hole 38 of the clamp 22, so that when the drive screw 50 rotates, the threads 52 drive the clamp 22 toward or away from the first and second flanges 12, 16 of the first and second tubular components 10, 14. As the threads 52 on the drive screw 50 drive the clamp 22, the drive screw 50 maintains substantially the same position relative to the housing 40, and does not travel inwardly or outwardly toward or away from the flanges 12, 16. In other words, the drive screw 50 may be fixed relative to the housing 40 in an axial direction. The drive screws 50 have a tool engagement slot 54 at an outer end thereof that can be used to turn the drive screw 50. For example, in the embodiments of FIGS. 1A and 1B, the drive screw 50 has a hexagon head that can be turned with a high impact gun using a hexagon attachment. The drive screws 50 may be made of a high strength material.

A guide bushing 56 may be provided in hole in the sidewall of the housing 40 to provide a path for, and help align, each drive screw 50 relative to the housing 40. The guide bushings 56 may be made of a high strength material, and may be bored to have a diameter with a close tolerance to the diameter of the drive screw 50 to guide the drive screw 50 through the housing 40. The guide bushing 56 may be removable to allow greater access to the drive screws 50 and the clamp 22.

Figure 2A:
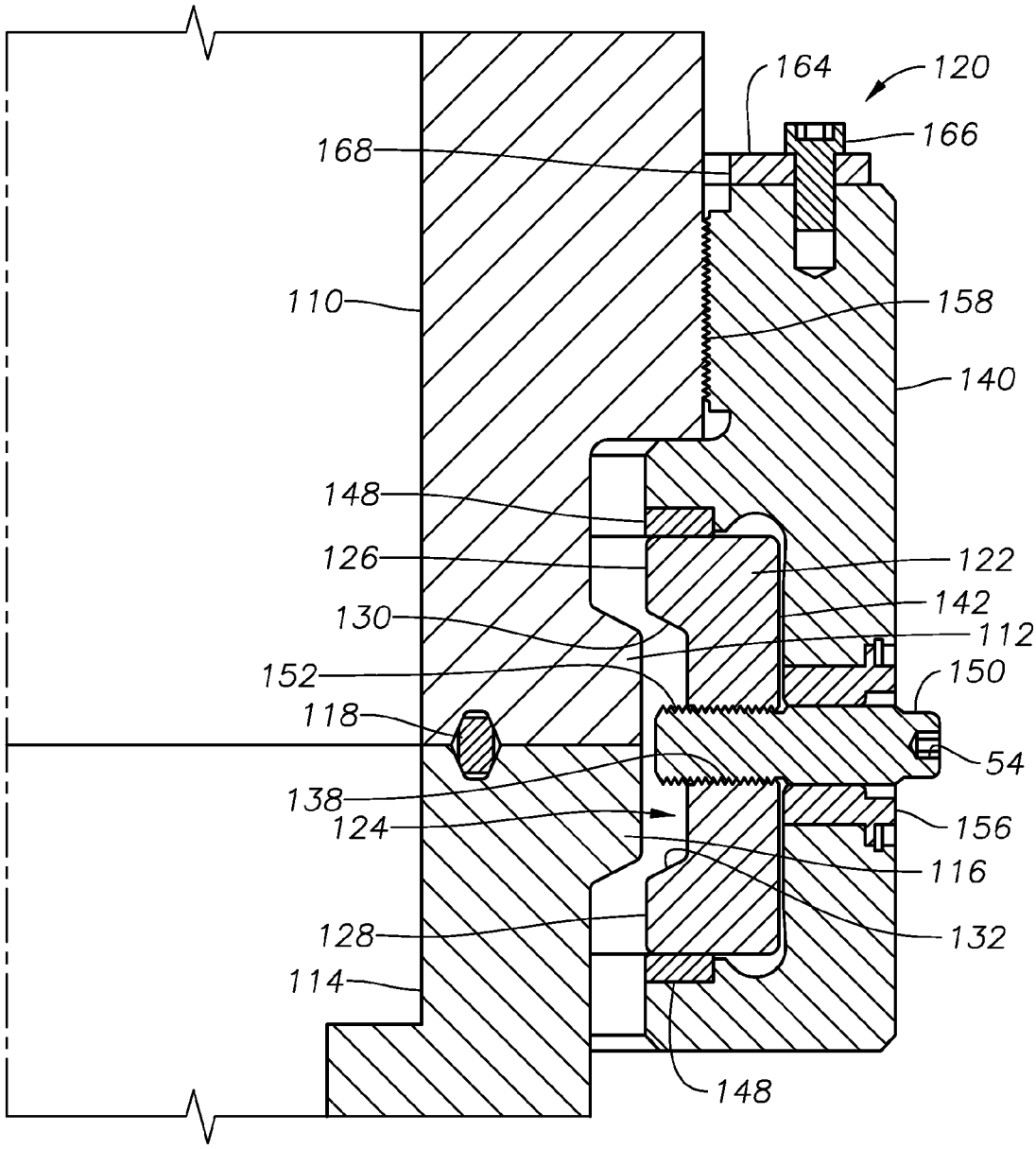
FIG. 2A is a side cross-sectional view of a connection assembly according to an alternate embodiment of the present technology, with the clamp in an unlocked position.
Figure 2B:
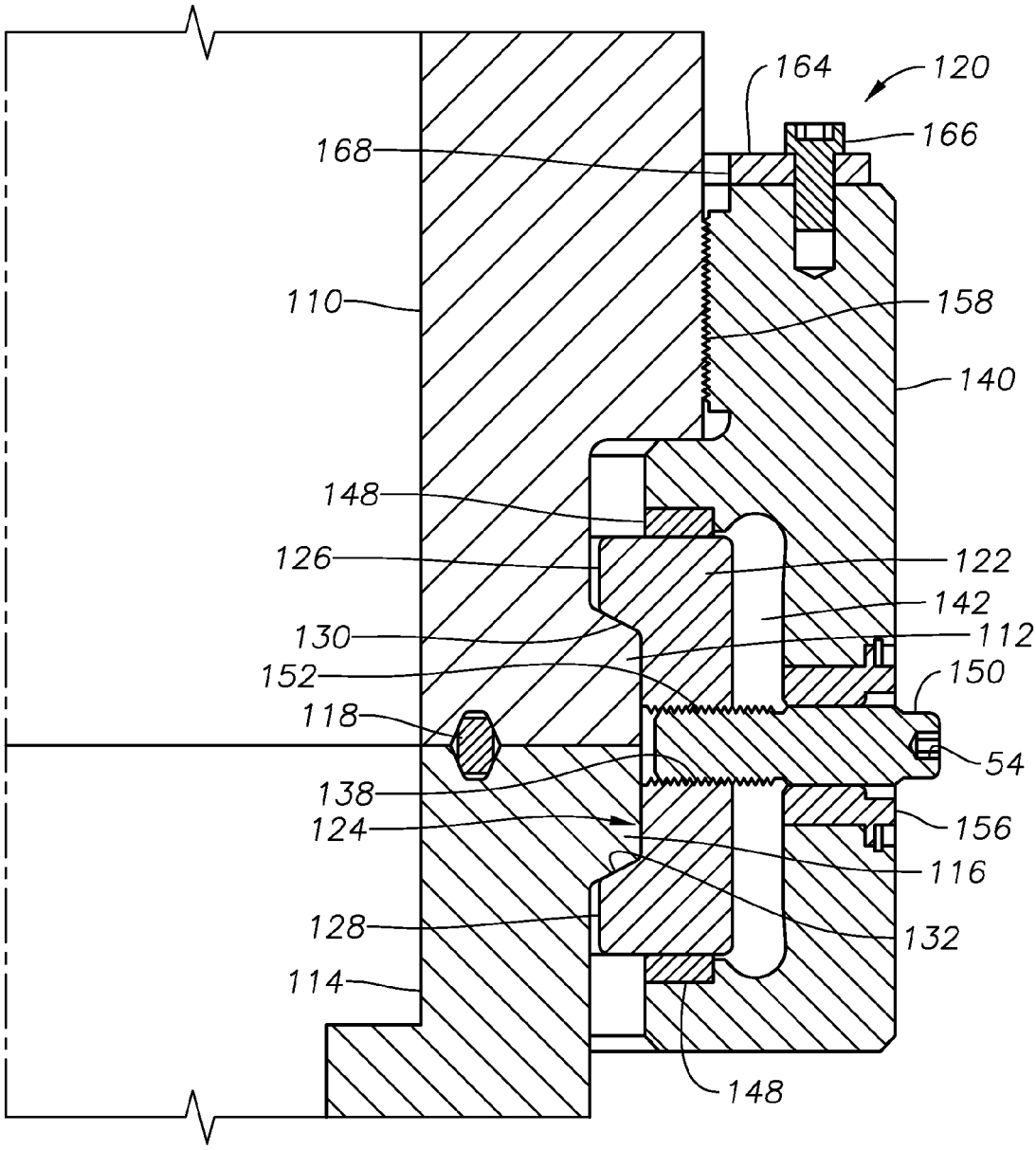
FIG. 2B is a side cross-sectional view of the connection assembly according to the embodiment of FIG. 2A, with the clamp in a locked position.

Referring now to FIGS. 2A and 2B, there is shown an embodiment of the present technology that is similar to that shown in FIGS. 1A and 1B, and discussed above. For example, the embodiment of FIGS. 2A and 2B includes a first tubular component 110 having a first flange 112, a second tubular component 114 having a second flange 116, and a seal 118 therebetween. Furthermore, the adapter assembly 120 includes a clamp 122, a housing 140, and drive screws 150 configured to drive the clamp 122 relative to the housing 140. The clamp 122 includes a recess 124, protrusions 126, 128 having angled surfaces 130, 132, and a threaded hole 138. The housing 140 includes a channel 142 in which the clamp 122 slides. Wear pads 148 may be inserted to maintain a separation between surfaces of the housing 140 and surfaces of the clamp 122, and to prevent wear to the surfaces of the housing 140 and the clamp 122, thereby prolonging the life thereof The drive screws 150 include threads 152 and are turned by inserting a tool into a tool engagement slot 154 and turning the drive screw 150. Bushings 156 are provided in the housing 140 to align the drive screws 150 with the housing 140. Each of the elements herein identified functions in a similar way to similar elements shown in FIGS. 1A and 1B and described above.

One feature of the embodiment shown in FIGS. 2A and 2B that is not described above, however, is the threads 158, which allow the housing 140 to be threadedly attached to the first tubular component 110, rather than being attached using fasteners, as shown in the embodiment of FIGS. 1A and 1B. The threads 158 extend circumferentially around the first tubular component 110, and an inner diameter of the housing 140. The ability to threadedly engage the housing 140 and the first tubular component 110 may be advantageous because it may provide a more secure connection and additional stability to the adapter assembly 120 relative to the first tubular component 110. Of course, although the housing 140 is shown in FIGS. 2A and 2B to be attached to the first tubular component 110, it may alternatively be attached to the second tubular component 114, or to both the first and second tubular components 110, 114 simultaneously.

Also shown in FIGS. 2A and 2B is a retainer plate 164 and bolt 166. The retainer plate 164 is positioned on top of the housing 140, and the bolt 166 attaches the retainer plate 164 to the housing 140. The inner surface 168 of the retainer plate 164 has a diameter that is less than the diameter of the threads 158, so that the retainer plate 164 cannot slide past the threads 158. Accordingly, the retainer plate 164, when mounted to the top of the housing 140, prevents the housing 140 from moving axially downward relative to the first tubular component 110 past the threads 158. Thus, the adapter assembly 120 cannot unthread and become detached from the first tubular member 110.

The method for locking first and second tubular components 10, 14 together using the adapter assembly 20 of the present technology includes first aligning the flanges 12, 16 of the first and second tubular components 10, 14. In addition, the adapter assembly 20 is installed on the upper tubular member 10. The adapter assembly 20 may be pre-assembled prior to installation on the first or second tubular components 10, 14. For example, the clamp 22 may be pre-attached to the housing 40 by passing the drive screws through the housing 40 and into threaded engagement with the holes 38 in the clamp sections, or dog segments. It may be desirable to turn the drive screws 50 so that the clamp 22 is fully retracted into the channel 42 of the housing 40 during installation. With the adapter assembly 20 assembled, the housing 40 may be attached to either the first or second tubular components 10, 14, or both, using the fasteners 44. Alternatively, the housing 40 may be threadedly engaged with at least one of the tubular components, as shown in FIGS. 2A and 2B.

Once the adapter assembly 20 is in place relative to the first and second tubular components 10, 14, with the housing attached thereto, the drive screws 50 can be turned, by engaging a tool with the tool engagement slots 54 at the end of each drive screw 50. As the drive screws 50 turn, the threads 52 of the drive screws engage with the threaded holes 38 of the clamp sections, and the clamp 22 is driven inward toward the flanges 12, 16 of the first and second tubular components 10, 14. The clamp 22 may be driven inward until the recess 24 accepts the flanges 12, 16. In some embodiments, the tapered surfaces 30, 32 of the upper and lower protrusions 26, 28 may engage the tapered surfaces 34, 36 of the first and second flanges 12, 16. As the tapered surfaces 30, 32 of the upper and lower protrusions 26, 28 engage the tapered surfaces 34, 36 of the first and second flanges 12, 16, the first and second flanges 12, 16 are squeezed together and the seal between the flanges is strengthened. With the clamp thus positioned, the first and second flanges 12, 16 are locked, and unable to separate.

While the technology has been shown or described in only some of its forms, it should be apparent to those skilled in the art that it is not so limited, but is susceptible to various changes without departing from the scope of the invention. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. An assembly for clamping first and second flanged tubular components, the assembly comprising:

a segmented clamp having a recess configured to accept the flanges of the first and second tubular components, and a hole oriented substantially perpendicular to the longitudinal axes of the first and second tubular components;

a housing surrounding an outer portion of the segmented clamp and configured for attachment to at least one of the first and second tubular components; and a drive screw that passes through the housing and is threadedly engaged with the hole of the segmented clamp, so that as the drive screw rotates it maintains a substantially fixed position relative to the housing so that it does not impede the radial clearance around the wellhead, the drive screw driving the segmented clamp perpendicularly relative to the first and second tubular components between a locked position, in which the circumferential recess engages the flanges of the first and second tubular components, and an unlocked position, in which the circumferential recess is positioned laterally out of engagement with the flanges of the first and second tubular components.

2. The assembly of claim 1, wherein the clamp comprises a plurality of clamp sections arranged to substantially surround the first and second tubular components, and wherein each clamp section has a hole in threaded engagement with a drive screw.

3. The assembly of claim 1, further comprising a wear pad between the clamp and the housing, the wear pad configured to prevent direct contact between surfaces of the clamp and the housing.

4. The assembly of claim 1, wherein the housing includes a guide bushing around the drive screw to maintain the alignment of the drive screw relative to the housing, and the guide bushing is discretely removable from the housing without removing the drive screw.

5. the assembly of claim 4, wherein the guide bushing and drive screw are discretely removable as a unit from the housing.

6. The assembly of claim 1, wherein the housing has radiused internal corners to reduce stress concentrations in the housing.

7. An adapter for clamping flanged ends of first and second tubular components, the adapter comprising:

a clamp having a plurality of dog segments that substantially surround the first and second tubular components, each dog segment having a hole extending therethrough in a direction perpendicular to the longitudinal axis of the first and second tubular components, and protrusions projecting inwardly toward the longitudinal axis of the tubular components, the protrusions spaced to engage the flanged ends of the tubular components when the clamp is positioned proximate the flanged ends, thereby restraining axial movement of the first and second tubular components relative to one another;

a housing surrounding an outer portion of the clamp and configured for removable attachment with a fastener to at least one of the first and second tubular components;

a plurality of drive screws that pass through the housing and threadedly engage the holes of the dog segments of the clamp, so that as each drive screw rotates, it drives a dog segment perpendicularly relative to the first and second tubular components between a locked position, in which the protrusions engage the flanged ends of the first and second tubular components, and an unlocked position, in which the protrusions are positioned outwardly from, and out of engagement with, the flanges of the first and second tubular components guide bushings around the plurality of drive screws that are discretely removable from the housing without removing the drive screws, and that maintain the alignment of the drive screws relative to the housing.

8. The adapter of claim 7, wherein the protrusions have inner flange engaging surfaces that are tapered to substantially correspond to tapered surfaces of the flanged ends of the first and second tubular components.

9. The adapter of claim 7, further comprising wear pads between the dog segments and the housing, the wear pads configured to prevent direct contact between surfaces of the dog segments and the housing.

10. The adapter of claim 7, wherein the each of the plurality of drive screws maintains a substantially fixed position relative to the housing so that it does not impede the radial clearance around the wellhead.

11. The adapter of claim 7, wherein the guide bushings and drive screws are removable from the housing as discrete units.

12. The adapter of claim 7, wherein the housing has radiused internal corners to reduce stress concentrations in the housing.

13. An adapter for clamping flanged ends of first and second tubular components, the adapter comprising:

a clamp having a plurality of dog segments that substantially surround the first and second tubular components, each dog segment having a hole extending therethrough in a direction perpendicular to the longitudinal axis of the first and second tubular components, and protrusions projecting inwardly toward the longitudinal axis of the tubular components, the protrusions spaced to engage the flanged ends of the tubular components when the clamp is positioned proximate the flanged ends, thereby restraining axial movement of the first and second tubular components relative to one another;

a housing surrounding an outer portion of the clamp and configured for threaded attachment to at least one of the first and second tubular components;

a plurality of drive screws that pass through the housing and threadedly engage the holes of the dog segments of the clamp, so that as each drive screw rotates, it drives a dog segment perpendicularly relative to the first and second tubular components between a locked position, in which the protrusions engage the flanged ends of the first and second tubular components, and an unlocked position, in which the protrusions are positioned outwardly from, and out of engagement with, the flanges of the first and second tubular components guide bushings around the plurality of drive screws to maintain the alignment of the drive screws relative to the housing, the guide bushings and plurality of drive screws being removable from the housing as discrete units.

14. The adapter of claim 13, wherein the protrusions have inner flange engaging surfaces that are tapered to substantially correspond to tapered surfaces of the flanged ends of the first and second tubular components.

15. The adapter of claim 13, further comprising wear pads between the dog segments and the housing, the wear pads configured to prevent direct contact between surfaces of the dog segments and the housing.

16. The adapter of claim 13, wherein the each of the plurality of drive screw maintains a substantially fixed position relative to the housing so that it does not impede the radial clearance around the wellhead.

17. The adapter of claim 13, wherein the guide bushings are discretely removable from the housing without removing the drive screw.

18. The adapter of claim 13, wherein the housing has radiused internal corners to reduce stress concentrations in the housing.

* * * * *